United States Patent [19]

Nobles et al.

[11] 4,136,539

[45] Jan. 30, 1979

[54] HEAVY EQUIPMENT LOCK

[76] Inventors: Phillip C. Nobles, 36 Kathryn Dr., Pleasant Hill, Calif. 94523; Mark A. Noble, 1400 Creekside Dr., Walnut Creek, Calif. 94596

[21] Appl. No.: 868,866

[22] Filed: Jan. 12, 1978

[51] Int. Cl.[2] ..... E05B 73/00

[52] U.S. Cl. ..... 70/18

[58] Field of Search ..... 70/18, 30, 32, 33, 34, 70/49, 379 R, 380; 292/140, 143, 169.15, 169.17, 173

[56] References Cited

U.S. PATENT DOCUMENTS

| | | | |
|---|---|---|---|
| 1,486,037 | 3/1924 | Rousseau | 70/455 |
| 1,503,210 | 7/1924 | Shannon | 70/18 |

*Primary Examiner*—Robert L. Wolfe

*Attorney, Agent, or Firm*—Phillips, Moore, Weissenberger, Lempio & Majestic

[57] ABSTRACT

A lock is provided which is adaptable to heavy equipment, such as truck tractors or earth-moving vehicles, for equipment security. The equipment lock includes an elongated shackle with a split ferrule bondingly associated at one end. The split ferrule is received by a casing in which the split ferrule is lockingly engaged by a slidable yoke member actuated both for locking and release by key operation through means of a cam assembly. An enlarged member is at the shackle second end. The heavy equipment lock may be made to be watertight when locked. In one embodiment, the shackle is flexible and formed into an adjustable bight to secure vehicle wheels. In a second embodiment the shackle is a rigid, "L" shaped bar.

9 Claims, 5 Drawing Figures

FIGURE 3.
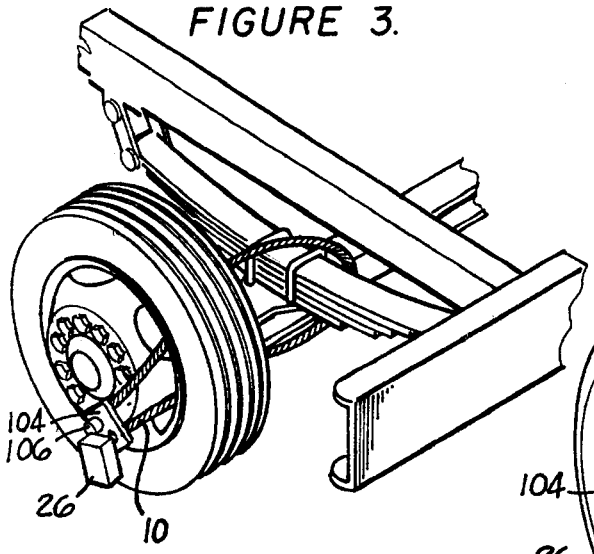
FIGURE 4.
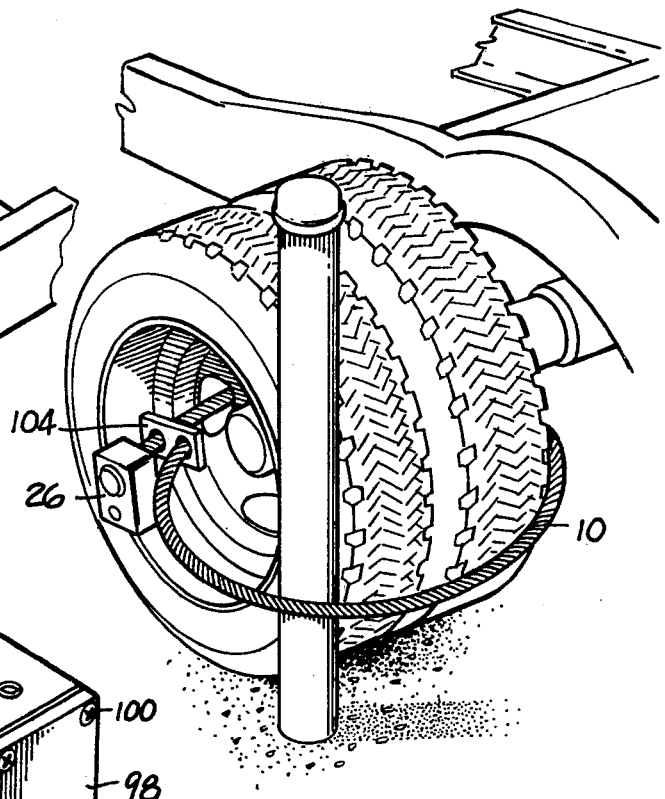
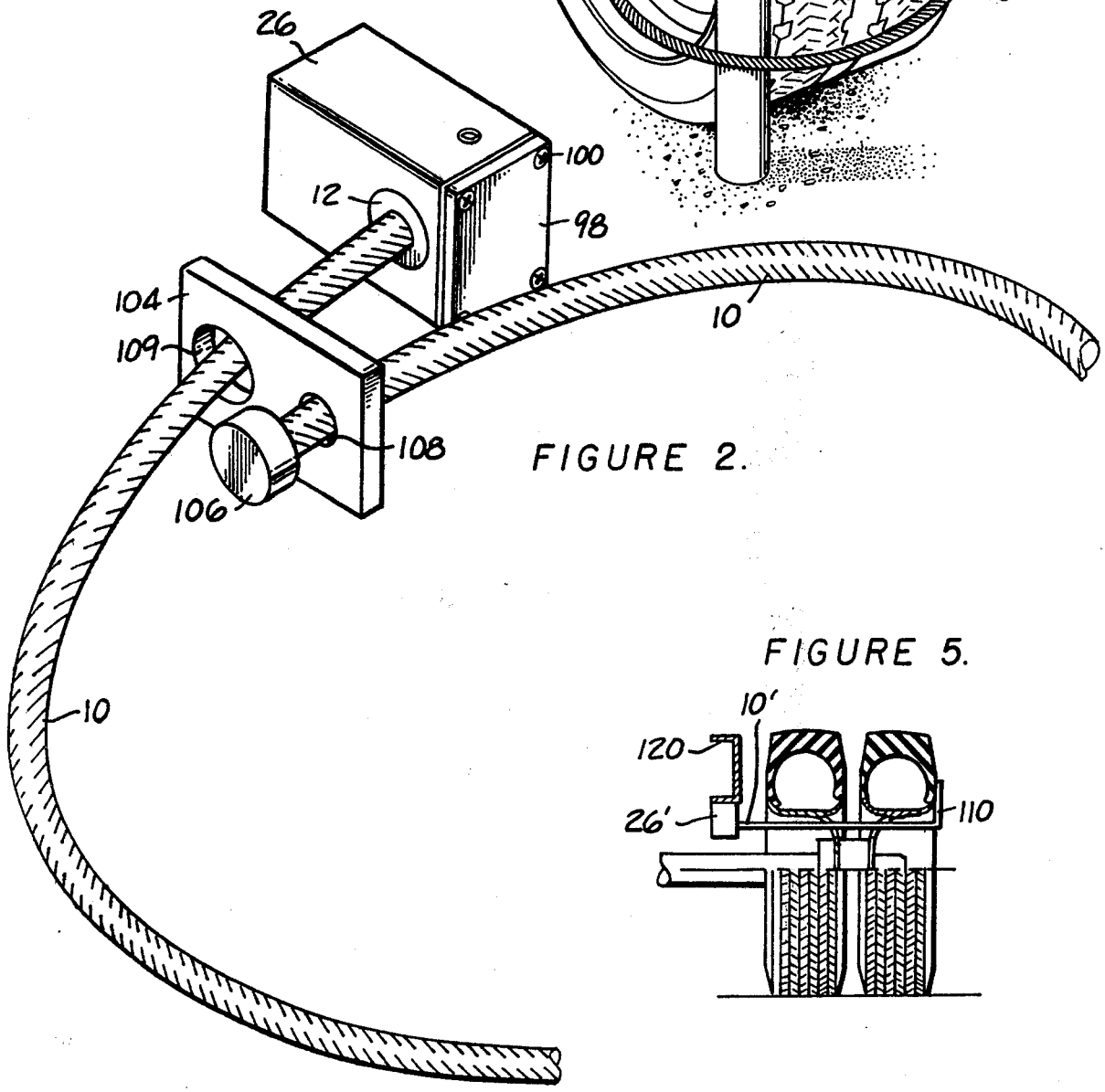
FIGURE 2.
FIGURE 5.

HEAVY EQUIPMENT LOCK

BACKGROUND OF THE INVENTION

1. Field of the Invention

This invention relates to shackling heavy equipment, particularly to the manner in which the shackle is lockingly engaged.

2. Description of the Prior Art

Heavy equipment, such as truck tractors and trailers, construction or farm vehicles, must frequently be left unattended on the work site during job progress, or stored in large, open equipment yards. The equipment may be dangerous if operated by non-authorized and unfamiliar personnel. Furthermore, security of the heavy equipment is always of concern.

A variety of shackling locks are known to the art. The most common are cable padlocks. These prior art cable padlocks are inflexible in use for heavy equipment as they provide a particular length of cable which forms a certain sized loop when both cable ends are engaged in the padlock. As a result, a particular one of these prior art padlocks is not easily adaptable between various types and sizes of equipment. Rather, each piece of equipment must have its own particularly sized conventional cable padlock. Equally important is that existing locks are of insufficient size and strength.

Accordingly, prior art security devices for heavy equipment have been found to be unsatisfactory.

SUMMARY OF THE INVENTION

The present invention is directed to overcoming the problems hitherto presented in securing heavy equipment.

The present invention provides an elongated shackle with a split ferrule bondingly associated at one end and an enlarged member at the other end. A casing member receives the split ferrule through an aperture in the casing. A yoke member slides within the casing between a first, or locking, position to lockingly engage the split ferrule and a second, or releasing, position. The yoke is urged between the first and second position by actuating means operated by a key inserted into a casing orifice.

DESCRIPTION OF THE DRAWINGS

In the drawings.

FIG. 2 is a perspective view of one embodiment of the invention;

FIG. 3 is an illustration of the embodiment as in FIG. 2 adapted to a heavy equipment vehicle;

FIG. 4 is an illustration of the embodiment as in FIG. 2 adapted to a heavy equipment vehicle and a post;

FIG. 5 is a front view of a vehicle incorporating a second embodiment of the present invention.

DESCRIPTION OF THE PREFERRED EMBODIMENT

Figure 1:
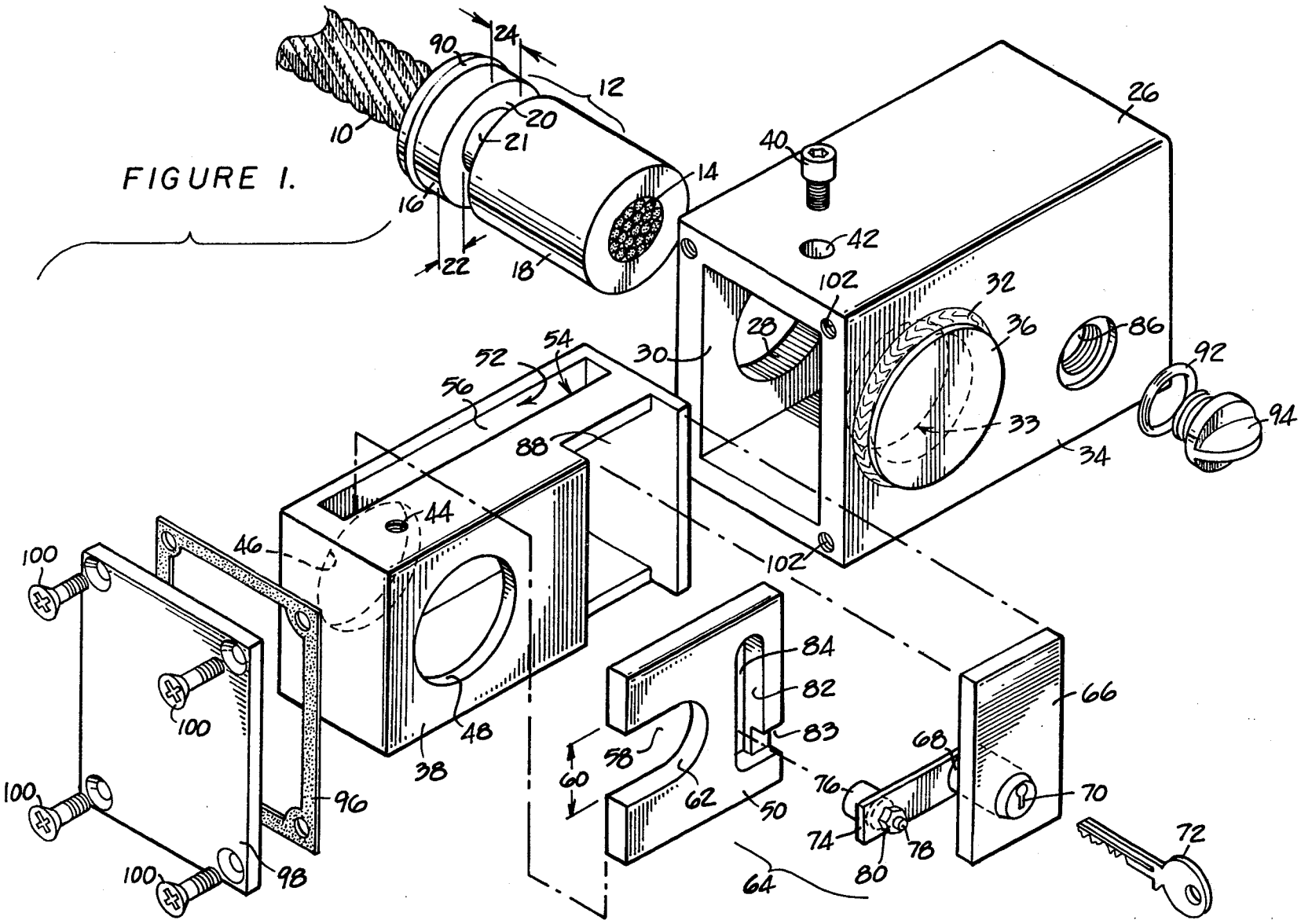
FIG. 1 is an exploded view of the locking device of the present invention.

Referring first to FIG. 1, there is illustrated an elongated shackle 10 with a split ferrule 12 bondingly associated at a shackle first end 14. The shackle must be of a hard, tough material, preferrably metallic, which is resistent to severing such as by means of a manual shearing device. In a first embodiment, illustrated by FIGS. 2, 3 and 4, the shackle 10 is composed of stranded, flexible steel cable or wire rope. In a second embodiment, illustrated by FIG. 5 the shackle 10 is a rigid, metallic bar.

The split ferrule 12 comprises tubular members 16 and 18 in a spaced linear relationship from each other to provide a spool 20 configuration. Spool 20 includes an inner core 21 with a depth 22 with respect to the outer diameter of tubular members 16, 18, and a width 24. It should be understood that spool 20 may be of unitary construction as indicated or alternatively built up separate pieces, the whole being welded for example.

Split ferrule 12 is bondingly associated with shackle 10 by conventional process such as swaging or pouring in the embodiment wherein the shackle is flexible. In the second embodiment of the present invention, wherein shackle 10 is a rigid bar, split ferrule 12 is preferrably bondingly associated with shackle 10 by welding to shackle 10 either as two initial members, or by welding a single initial tubular member in which spool 20 has been formed by machining.

A casing 26, such as a metallic box herein illustrated, includes an aperture 28 in casing wall 30 of sufficient size and shape to closely receive split ferrule 12.

Tubular member 18 of split ferrule 12 is of sufficient length to provide strength against tampering. Casing 26 preferrably includes sleeve 32 outwardly extending from casing wall 34, sleeve 32 being opposite and centered on aperture 28, and for permitting casing 26 to receive the full length of split ferrule 12 without greatly increasing the weight of casing 26. Sleeve 32 is closed by cap 36.

In use, the split ferrule is snugly received by aperture 28, passed through casing 26, and with the tubular member 18 of split ferrule 12 extended into sleeve 32 until shackle end 14 abuts cap 36. Sleeve 32 may assist in centering and placing split ferrule 12 within casing 26 prior to locking.

Within casing 26 is retaining member 38 positioned in casing 26 by set screw 40. Set screw 40 may be counter sunk in casing 26 through casing hole 42, and firmly engaged with screw threads formed along the surface of screw hole 44 of retaining member 38. Retaining member 38 includes apertures 46 and 48 of sufficient size for passing split ferrule 12 therethrough with apertures 46 and 48 in respective corresponding relationship to aperture 28 and sleeve 33.

Yoke member 50 is slidably mounted within retaining member 38, the mounting comprising facing surfaces 52, 54 which lie parallel to each other. Facing surfaces 52, 54 define two walls of a substantially rectilinear groove 56 in retaining member 38 into which yoke member 50 is mounted for guiding movement in a linear direction.

Yoke member 50 defines a "U" shaped notch 58 whose height 60 is of sufficient dimension to engage inner core 21 of split ferrule 12 along a bearing surface 62 of notch 58. Yoke member 50 is slidable rightwardly and leftwardly in groove 56 so that notch 58 may obtrude into the cylinder defined by apertures 28, 46 and 48, 33. When yoke member 50 is moved rightwardly and thus withdrawn, it is in a second, or releasing position in groove 56. When yoke member 50 is moved leftwardly in a first, or locking, position, yoke member 50 is in line with respect to apertures 46, 48, in groove 56. Yoke member 50 must be of sufficient width to smoothly slide into spool 20, as provided by width 24.

Associated with casing 26 is actuating means, shown generally by 64. Actuating means 64 comprises key plate 66 with which key mechanism 68 including key hole 70 is associated. A key 72 may actuate key mechanism 68. Key mechanism 68 may be any commercially available tumbler lock but preferrably is of a high security type having angled tumbler pins. Throw rod 74 is affixed at one end to key mechanism 68 and associated at a second end with cam roller 76. Throw rod 74 may be affixed to key mechanism 68 by conventional means such as welding or a fastener (not shown). Where a conventional fastener is used, groove 83 can accomodate the fastener for permitting the full rightward displacement of yoke member 50 in groove 56. Cam roller 76 includes stem 78 which is firmly held to throw rod 74 by means such as nut 80, for permitting radial movement of cam roller 74 responsive to operation of key 72. The actuating means 64 further includes means such as cam race 82 wherein cam race 82 and cam roller 76 together define a cam assembly. Cam race 82 operates for restricting relative movement of the cam roller 74 to lateral motion with respect to movement of yoke member 50 between the first and second position. Cam race 82 is preferrably integrally formed with yoke member 50, and defines a slot 84 upon whose surfaces cam roller 74 rollingly rides. Groove 83 normal to cam race 82 is provided for assembly purposes.

Casing 26 further includes threaded orifice 86 of sufficient size to permit insertion of key 72 therethrough. Actuating means 64 is assembled within casing 26 in a cut out 88 as shown by the dashed lines in retaining member 38, cut out 88 of a size and shape to partially enclose key plate 66. When actuating means 64 along with retaining member 38 is assembled within casing 26, orifice 86 is centered above key hole 70.

Casing 26 is preferrably water-tight when split ferrule 12 is lockingly received therein. Water-tight integrity is obtained by means of O-ring 90 on tubular member 16 for sealing engagement with aperture 28; O-ring 92 between orifice 86 and a thumb set screw 94, with screw 94 threaded to mate with threads on orifice 86; and gasket 96 between casing end wall 98 and casing 26, with wall 98 fastened to casing 26 by a plurality of machine screws 100, each threadable through end wall 98 and gasket 96 for engagement with a corresponding one of tapped hole 102 in casing 26. Water-tight integrity coupled with stainless steel material permits underwater use without impairment of the key mechanism.

In operation, when key 72, which is elongated to pass through orifice 86, is rotated in a clockwise direction, cam roller 74 will move responsively upward, being restricted to a linear path relative to cam race 82, for urging yoke member 50 to the rightward portion of groove 56, whereby yoke member 50 is in the second, or releasing, position. Alternatively, when key 72 is rotated in a counter-clockwise direction, cam roller 74 is restricted to a linear downward travelling direction relative to cam race 82 thus urging yoke member 50 leftwardly in groove 56 to the first, or locking position.

Turning to FIG. 2 in the first embodiment the inventive lock further comprises stop member 104 slidably mounted on shackle 10 between the split ferrule 12 and an enlarged member, herein illustrated in the first embodiment as second ferrule 106. Second ferrule 106 is bondingly associated with shackle 10 by means such as swaging or pouring process. The slidable mounting of stop member 104 is preferrably achieved wherein an orifice 108 is defined by stop member 104 of sufficient size to loosely enclose shackle 10 without permitting passage of either ferrule 106 or split ferrule 12 therethrough. Stop member 104 further includes bore 109 of sufficient size to receive split ferrule 12 threadably therethrough for forming a bight in shackle 10.

Use of the first embodiment is more clearly shown in FIGS. 3 and 4 wherein FIG. 3 illustrates the heavy equipment lock of the present invention, the shackle 10 forming a bight by passing shackle 10 through apertures in portions of an earth-moving vehicle wheel and about the vehicle frame; FIG. 4 illustrates adaption of the inventive lock to a heavy equipment vehicle parked along-side a post.

Turning to FIG. 5, there is illustrated the second embodiment of the present invention wherein shackle 10' is a rigid rod, casing 26' is fixedly attached to the underside of a vehicle frame 120, as by welding, and the enlarged member extends radially outwardly from the shackle 10' to form an "L" shaped restraint.

Important to this invention is the size of the lock relative the vehicle. It has been found that shackle 10 may be of 1 inch (2.54 cm) wire rope. With material at this size, the potential thief or unauthorized user will be thwrated in most any instance.

While the invention has been particularly shown and described with reference to the preferred embodiments thereof, it will be understood by those skilled in the art that the foregoing and other changes in form and details may be made therein without departing from the spirit and scope of the invention.

The embodiments of the invention in which an exclusive property or privilege is claimed are defined as follows:

1. A heavy equipment lock operable by a key comprising:

a split ferrule;

an elongated shackle with said split ferrule bondingly associated to one end and defining an enlarged member at the other end;

a casing member defining an aperture for receiving said split ferrule, and an orifice for receiving a key;

a yoke member slidably disposed within the casing member and movable between a first position and a second position, the yoke member for lockingly engaging said split ferrule with said yoke member in said first position and with said split ferrule received in said aperture; and a cam assembly disposed within the casing member and responsive to movement of a key to urge said yoke member between said first position and said second position, the cam assembly including a cam roller and cam race means in operative engagement with the cam roller, the cam race means integrally formed with the yoke member and restricting movement of the cam roller for urging linear movement of the yoke member between the first and second position.

2. The lock of claim 1 wherein the cam race means defines a groove in which the cam roller rides, the groove for restricting movement of the cam roller to lateral motion with respect to movement of the yoke member between the first and second position.

3. The lock of claim 2 wherein the shackle is flexible.

4. The lock of claim 3 wherein the enlarged member at the second end comprises a second ferrule bondingly associated to the enlongated shackle.

5. The lock of claim 4 further comprising a stop member slidably mounted on the shackle between the split ferrule and the second ferrule.

6. The lock of claim 5 wherein the stop member further includes a bore therethrough of sufficient size to receive the split ferrule to form a bight in the shackle.

7. The lock of claim 2 wherein the shackle is rigid.

8. The lock of claim 7 wherein the enlarged member extends radially outwardly from the shackle.

9. The lock of claim 1 wherein the casing is substantially water-tight when the split ferrule is received therein.

* * * * *